US010100596B2

(12) United States Patent
Roth et al.

(10) Patent No.: US 10,100,596 B2
(45) Date of Patent: Oct. 16, 2018

(54) HANGER FOR AN UMBILICALLY DEPLOYED ELECTRICAL SUBMERSIBLE PUMPING SYSTEM

(71) Applicant: Saudi Arabian Oil Company, Dhahran (SA)

(72) Inventors: Brian A. Roth, Dhahran (SA); Jinjiang Xiao, Dharan (SA); Rafael Lastra, Dharan (SA)

(73) Assignee: Saudi Arabian Oil Company, Dhahran (SA)

( * ) Notice: Subject to any disclaimer, the term of this patent is extended or adjusted under 35 U.S.C. 154(b) by 310 days.

(21) Appl. No.: 14/856,086

(22) Filed: Sep. 16, 2015

(65) Prior Publication Data

US 2016/0076330 A1 Mar. 17, 2016

Related U.S. Application Data

(60) Provisional application No. 62/051,431, filed on Sep. 17, 2014.

(51) Int. Cl.

| | |
|---|---|
| ***E21B 19/02*** | (2006.01) |
| ***E21B 19/12*** | (2006.01) |
| ***E21B 33/04*** | (2006.01) |
| ***E21B 43/12*** | (2006.01) |

(52) U.S. Cl.

CPC ..... *E21B 33/0422* (2013.01); *E21B 19/02* (2013.01); *E21B 19/12* (2013.01); *E21B 43/128* (2013.01)

(58) Field of Classification Search

CPC ..... E21B 19/02; E21B 19/12; E21B 33/0422; E21B 43/128

See application file for complete search history.

(56) References Cited

U.S. PATENT DOCUMENTS

| | | | | |
|---|---|---|---|---|
| 3,130,987 A * | 4/1964 | Johnson | ..... | E21B 33/0422 285/123.8 |
| 4,646,827 A | 3/1987 | Cobb | | |
| 4,823,919 A | 4/1989 | Hayatdavoudi | | |
| 5,515,926 A | 5/1996 | Boychuk | | |
| 5,988,273 A | 11/1999 | Monjure et al. | | |
| 6,089,338 A * | 7/2000 | Bouligny, Jr. | ..... | E21B 19/10 166/75.14 |

(Continued)

FOREIGN PATENT DOCUMENTS

| | | |
|---|---|---|
| CN | 202900112 U | 4/2013 |
| WO | 2009112853 A2 | 9/2009 |
| WO | 2013158030 A1 | 10/2013 |

OTHER PUBLICATIONS

International Search Report and Written Opinion PCT/US2015/050502 dated Dec. 15, 2015.

*Primary Examiner* — Matthew R Buck

(74) *Attorney, Agent, or Firm* — Bracewell LLP; Constance G. Rhebergen; Keith Ron Derrington

(57) ABSTRACT

A tubing hanger assembly for use in a wellhead assembly that includes tubing hanger member, a retainer that lands in the hanger member, and slip assembly landed in the retainer that supports a string of composite tubing and an electrical submersible pump assembly (ESP). The tubing and ESP are disposed in a wellbore formed beneath the wellhead assembly. The slip assembly is non-marking and includes grit on its inner surface rather than teeth.

19 Claims, 4 Drawing Sheets

(56) References Cited

U.S. PATENT DOCUMENTS

| | | | | |
|---|---|---|---|---|
| 6,305,649 | B1 * | 10/2001 | Walmsley | E21B 19/10 248/313 |
| 6,481,498 | B1 | 11/2002 | Ackroyd | |
| 6,672,394 | B2 | 1/2004 | Neal | |
| 6,755,097 | B2 | 6/2004 | Bangert | |
| 6,820,705 | B2 * | 11/2004 | Baugh | E21B 19/10 166/382 |
| 7,231,984 | B2 | 6/2007 | Jaensch | |
| 7,533,719 | B2 | 5/2009 | Hinson et al. | |
| 8,056,621 | B2 | 11/2011 | Ring et al. | |
| 8,678,112 | B2 * | 3/2014 | Vatne | E21B 19/10 166/75.14 |
| 2005/0133228 | A1 | 6/2005 | Shampine et al. | |
| 2012/0298372 | A1 * | 11/2012 | Bamford | B66C 13/02 166/338 |
| 2013/0043034 | A1 | 2/2013 | Drablier et al. | |
| 2015/0330194 | A1 * | 11/2015 | June | E21B 17/003 166/351 |
| 2017/0183935 | A1 * | 6/2017 | Brown | E21B 33/0385 |

* cited by examiner

HANGER FOR AN UMBILICALLY DEPLOYED ELECTRICAL SUBMERSIBLE PUMPING SYSTEM

This application claims priority to and the benefit of U.S. Provisional Application Ser. No. 62/051,431, filed Sep. 17, 2014, the full disclosure of which is hereby incorporated by reference herein for all purposes.

BACKGROUND OF THE INVENTION

1. Field of the Invention

The present disclosure relates in general to a device for supporting an umbilical and electrical submersible pump ("ESP") assembly in a wellbore. More specifically, the present disclosure relates to a device for supporting a tabular made of composite with a hanger having a non-marking grit that engages the tubular.

2. Description of Related Art

Electrical submersible pumping ("ESP") systems are deployed in some hydrocarbon producing wellbores to provide artificial lift to deliver fluids to the surface. The fluids, which typically are liquids, are made up of liquid hydrocarbon and water. When installed, a typical ESP system is suspended in the wellbore at the bottom of a string of production tubing. In addition to a pump, ESP systems usually include an electrically powered motor and seal section. The pumps are often one of a centrifugal pump or positive displacement pump.

Centrifugal pumps usually have a stack of alternating impellers and diffusers coaxially arranged in a housing along a length of the pump. The impellers are connected by a shaft that connects to the motor; rotating die shaft said impellers forces fluid through passages that helically wind through the stack of impellers and diffusers. The produced fluid is pressurized as it is forced through the helical path in the pump. The pressurized fluid is discharged from the pump and into the production tubing, where the fluid is then conveyed to surface for distribution downstream for processing.

Some ESP systems deploy the pump on a lower end of the production tubing so that the pump is supported by the tubing when downhole. In these applications, an upper end of the production tubing is usually suspended from a support within a wellhead assembly that is mounted at surface. The supports sometimes include slips between the tubing and wellhead assembly, where the slips have profiled outer surfaces that are slidable along complementary profiled surfaces in the wellhead assembly. Typically, the slips are split members that fit around the upper end of the tubing, and while on the tubing, are then lowered so the slips engage the profiled surfaces in the wellhead assembly. The weight of the tubing and pump pulling the slips downward transfers to lateral forces that wedge the slips between the tubing and wellhead assembly to couple the tubing to the wellhead assembly. To enhance gripping between the slips and the tubing, the inner surface of the slips facing the tubing often includes a series of teeth. However, the size and configuration of the teeth usually forms indentations on the outer surface of the tubing.

SUMMARY OF THE INVENTION

Disclosed herein are examples of a device for supporting tubing in a wellbore. In one example, the disclosed system is for producing fluid from a wellbore, and which includes; a wellhead assembly disposed proximate an opening of the wellbore, an annular umbilical having a portion in the wellhead assembly and a portion that depends into the wellbore, a connector assembly supported in the wellhead assembly and comprising, an annular connector housing, an annular slip assembly retained in the connector housing, and particles embedded in an inner surface of the slip assembly and that project radially inward into engaging contact with an outer surface of the umbilical, and a downhole assembly coupled to a portion of the umbilical distal from the wellhead assembly. In an embodiment, engagement between the particles and umbilical is non-marking. The umbilical can be a composite tubing. In one example, the downhole assembly is an electrical submersible pumping system and which discharges fluid into the umbilical for pumping the fluid to the wellhead assembly. Alternatively, the connector assembly is an upper connector assembly, and the system further includes a lower connector assembly which is made up of an annular connector housing, an annular slip assembly retained in the connector housing, and particles embedded in an inner surface of the slip assembly that project radially inward into engaging contact with an outer surface of the umbilical. In this example the lower connector assembly couples the downhole assembly to the umbilical, and the annular connector housing of the lower connector assembly is in engaging contact with an inner surface of a housing of the downhole assembly. Optionally, an inner surface of the connector housing has a diameter that is profiled radially inward to define a frusto-conical shoulder, the retainer has an end supported on the shoulder, and the end of the retainer is profiled complementary to the shoulder, so that when the particles grip the umbilical, the retainer is urged radially inward and to increase a gripping force exerted by the retainer against the umbilical. The retainer can be made up of curved sections that fit into a recess formed on an inner surface of the retainer. In an example, the connector assembly lands on a support formed in the wellhead assembly. In one alternate embodiment, the connector assembly is an upper connector assembly and the downhole assembly is an electrical submersible pumping system that is coupled to the umbilical with a lower connector assembly. A matrix can be provided on the inner surface of the slip assembly and in which the particles are disposed. The matrix can be a material such as epoxy, a brazed material, or combinations thereof. In an embodiment, a diameter of the slip assembly tapers radially inward from an upper end to a lower end, and wherein an inner diameter of the retainer tapers radially inward along a path that corresponds to the diameter of the slip assembly, so that a force applied from the slip assembly to the umbilical is uniform along a length of an interface between the slip assembly and the umbilical. A series of triangular shaped projections can be formed on an outer surface of the slip assembly and which fit into a series of triangular shaped recesses on an inner surface of the retainer, so that a force applied from the slip assembly to the umbilical is uniform along a length of an interface between the slip assembly and the umbilical.

Also disclosed herein is a system for producing fluid from a wellbore and which includes a wellhead assembly mounted at an opening of the wellbore, an annular umbilical that depends into the wellbore and that has an end supported in the wellhead assembly, an upper connector assembly supported in the wellhead assembly and which includes, an annular connector housing, an annular slip assembly retained in the connector housing, a matrix material on an inner surface of the slip assembly, and particles embedded in the matrix material that project radially inward info engaging contact with an outer surface of the umbilical and that are disposed so that the loading between the slip assembly and the umbilical is substantially uniform along an axial length of an interface between the slip assembly and the umbilical. Also included in this embodiment of the system is a downhole assembly coupled to a portion of the umbilical distal from the wellhead assembly and a lower connector assembly supported in the wellhead assembly and which includes, an annular connector housing in compressive engagement with a housing of the downhole assembly, an annular slip assembly retained in the connector housing, a matrix material on an inner surface of the slip assembly, and particles embedded in the matrix material that project radially inward into engaging contact with an outer surface of the umbilical and that are disposed so that the loading between the slip assembly and the umbilical is substantially uniform along an axial length of an interface between the slip assembly and the umbilical. In an example, the particles include a material such as silicon, silicon carbide grit, or combinations thereof, and wherein the particles protrude from the matrix a height of up to about 0.03 inches.

Also disclosed herein is a system for producing fluid from a wellbore which is made up of a wellhead assembly disposed proximate an opening of the wellbore, a tubular member that is formed of a composite material and that has a portion in the wellhead assembly and a portion that depends into the wellbore, an upper connector assembly supported in the wellhead assembly that includes an annular connector housing, an annular slip assembly retained in the connector housing, and particles embedded in an inner surface of the slip assembly and that project radially inward into engaging contact with an outer surface of the tabular member. The system further includes an electrical submersible pumping assembly that has a pomp and a housing, and that is coupled to the portion of the tubing that depends into the wellbore and a lower connector assembly disposed within the electrical pumping assembly; where the lower connector assembly includes an annular connector housing that compressively engages an inner surface of the housing of the electrical submersible pumping assembly, an annular slip assembly retained in the connector housing, and particles embedded in an inner surface of the slip assembly and that project radially inward into engaging contact with an outer surface of the tubular member. The loading between the slip assembly of the upper connector assembly and the tubing can be substantially uniform along an axial length of an interface between the slip assembly of the upper connector assembly and the tubing. Optionally, an inner surface of the connector housing has a diameter that is profiled radially inward to define a frusto-conical shoulder, wherein the retainer has an end supported on the shoulder, and wherein the end of the retainer is profiled complementary to the shoulder, so that when the particles grip the umbilical, the retainer is urged radially inward and to increase a gripping force exerted by the retainer against the umbilical, and wherein the retainer has curved sections. The slip assembly of the system can be non-marking.

BRIEF DESCRIPTION OF DRAWINGS

Some of the features and benefits of the present invention having been stated, others will became apparent as the description proceeds when taken in conjunction with the accompanying drawings, in which.

Figure 2:
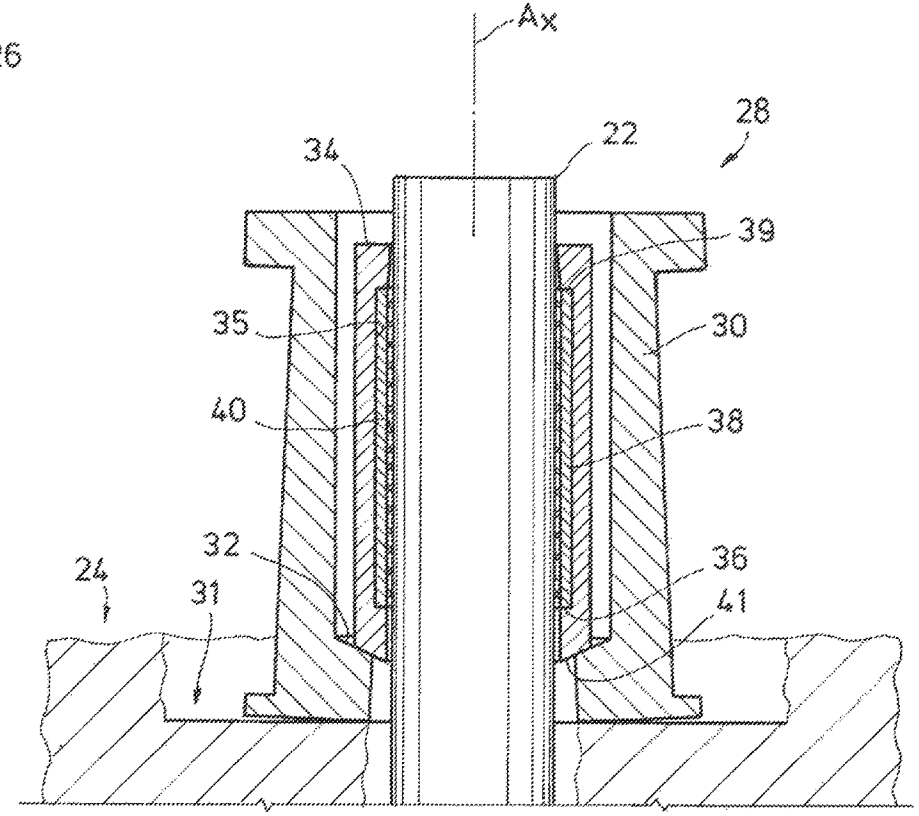
FIG. 2 is a side sectional view of an example of a connector assembly for use in supporting the tabular and ESP system.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes −/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 1:
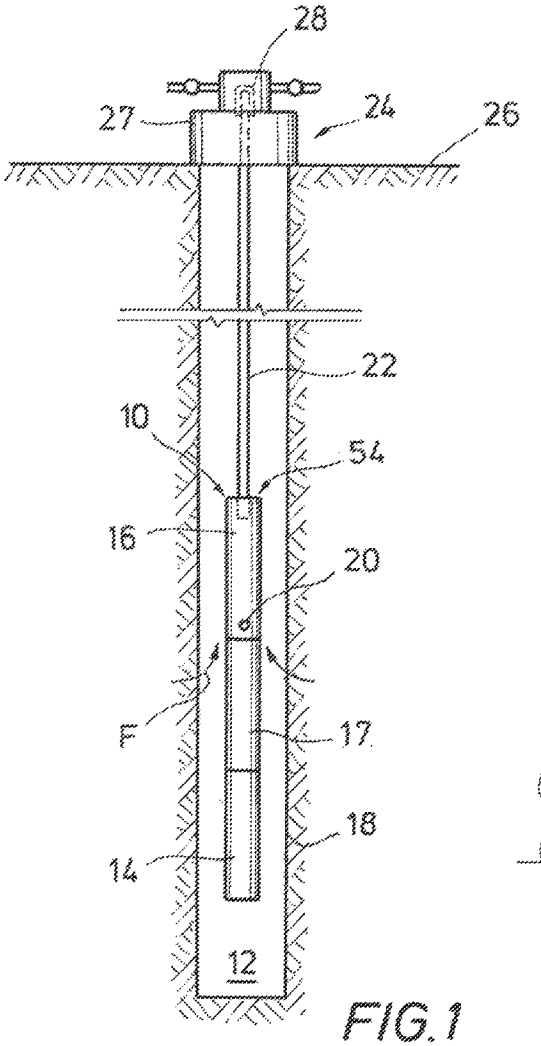
FIG. 1 is a side sectional view of an example of an ESP system suspended in a wellbore on a string of tubing.

FIG. 1 shows in side sectional view one example of an electrical submersible pump ("ESP") assembly 10 disposed in a wellbore 12. The ESP of FIG. 1 includes a motor 14 on its lowermost end which is used to drive a pump 16; where pump 16 is shown on an upper portion of the ESP assembly 10. Between the motor 14 and pump 16 is a seal section 17 for equalizing pressure within ESP assembly 10 with that of wellbore 12. A shaft (not shown) extends through the seal section 17 between file motor 14 and pump 16, and is for rotating impellers (not shown) disposed within pump 16. Fluid F is shown entering wellbore 12 front a formation 18 adjacent wellbore 12, fluid F flows to an inlet 20 formed in the housing of pump 16. Fluid F being pressurized within pump 16, exits into a string of tubing 22 shown mounted on a discharge end of pump 16, and which is supported on its upper end at a wellhead assembly 24 on surface 26. In the illustrated example, tubing 22 is also used to deploy and support ESP assembly 10 within wellbore 12. Wellhead assembly 24 includes a wellhead housing 27 shown on surface 26. Example embodiments exist where a portion of housing 27 projects into wellbore 12 and below surface 26. A connector assembly 28 shown disposed within wellhead assembly provides a means for anchoring tubing 22 within wellhead assembly 24.

An example of connector assembly 28 is shown in side sectional view in FIG. 2. In a non-limiting example, the tubing 22, or any other tubular member shown supported by connector assembly 28 and depending into the wellbore is referred to as an umbilical. Embodiments exist wherein connectors, such as for connecting electrical lines, can be disposed within umbilical. Here connector assembly 28, includes an annular connector housing 30 which is shown landed on an upward facing ledge 31 formed within the wellhead assembly 24. A bore extends axially through connector housing 30. Ledge 31 can be formed directly on an inner surface of wellhead housing 27 (FIG. 1), or on a casing hanger provided within wellhead assembly 24. Ledge 31 defines an example of a support on which connector housing 30 is disposed. The diameter of the bore in connector housing 30 projects radially inward to define an upward facing shoulder 32 on an end of connector housing 30 proximate where it is supported on ledge 31. An annular retainer 34 is shown inserted into the bore of connector housing 30; retainer 34 rests on and is landed on shoulder 32. Shoulder 32 angles downward towards ledge 31 with distance proximate to an axis $A_X$ of connector assembly 28, and is profiled generally oblique to the axis $A_X$. A bore extending axially in retainer 34 with a radius that transitions radially inward proximate the upper and lower ends of the retainer 34 and which defines a recess 35 between the transitions. A lower end of recess 35 terminates where the bore of retainer 34 projects radially inward and forms a shoulder 36. An annular slip assembly 38 is shown disposed within recess 35 and resting on shoulder 36. A shoulder 39 is formed at an end of recess 35 distal from shoulder 36, so that slip assembly 38 is axially retained in retainer 34 by the opposing shoulders 36, 39. An upper end of tubing 22 is shown inserted within an axial bore that extends along the length of retainer 34.

Further in the example of FIG. 2, slip assembly 38 is shown engaged with the outer surface of tubing 22, where an engaging force exerted by slip assembly 38 onto tubing 22 is increased by particles 40 provided on the inner surface of slip assembly 38. An end 41 of retainer 34 landed on shoulder 32 is profiled so that its radial surface follows a path generally oblique to the axis $A_X$ of tubing 22. In an example, the profile of end 41 is complementary to the profile of shoulder 32, so that the weight of the tubing 22 and ESP assembly 10 below results in radially inward forces being applied onto the retainer 34 to increase gripping of the tubing 22 by slip assembly 38.

An advantage of me particles 40 is that while a retaining force is provided to maintain the tubing 22 and suspended ESP assembly 10 (FIG. 1), the interface between the slip assembly 38 and tubing 22 is non-marking. In one example the particles 40 include grit. In an alternative, the tubing 22 is formed from a composite material, bat may also be formed from a metal, a metallic component, metal alloys, or combinations thereof. Examples of composite material include thermoplastics, such as perfluoroalkoxy alkanes ("PFA"), fluorinated ethylene propylene ("FEP"), polytetrafluoroethylene ("PTFE"), polyether-ether-ketone ("PEEK"), and combinations thereof. In an additional example, composite materials include fiber reinforced thermoplastics, fibers (glass and/or carbon) embedded in a resin substrate (such as epoxy), graphite composites, carbon composites, combinations thereof, and the like.

The respective shapes of the connector housing 30, retainer 34, and slip assembly 38 provide a retaining force for holding the tubing 22 as the downward force to hold the tubing 22 slides the retainer 34 radially inward and along angled shoulder 32. The slip assembly 38 provides a low stress connector system that attaches to a tubular and supports a tensile load. Examples exist wherein the retainer 34 is a single member or a combination of two or more members; where each of the members has an axial length substantially the same as the retainer 34, but extends along a portion of the circumference of the retainer 34. In an alternate embodiment, the inner surface (or diameter) of retainer 34 substantially mirrors that of the outer surface (or diameter) of slip assembly 38. For example, in embodiments where the outer surface (or diameter) of the slip assembly 38 is tapered or profiled, the inner surface of the retainer 34 will be correspondingly tapered or profiled.

O-rings (not shown), or other types of seals, may optionally be included with the slip assembly 38 to isolate production fluids from within the connector assembly 28. In an example, the inner diameter of the slip assembly 38 is substantially the same as the outer diameter of the tubing 22 to provide full contact between the two. As described below, the slip assembly 38 can be segmented into at least two segments, or may have a single split along its axis to allow the slip assembly 38 to be installed onto the tubing 22. In one example, the particles 40 or grit on the inner diameter of the slip assembly 38 includes silicon, silicon carbide grit, or a similar type of material that provides high shear strength. The particles 40 or grit can be angular in shape to provide good penetration into the tubing 22 when set. The particles 40 or grit may be applied with a matrix material to provide a uniform coverage over the inner surface of slip assembly 38. The matrix material can be epoxy, brazed material, or combinations thereof. In an embodiment, the protrusion of the particles 40 or grit material above the matrix is small, such as less than or up to about 0.030". In an example, the particles 40 or grit are dendritic, with edges, and not rounded. The surface having the particles 40 or grit area may determine the shear stress and maximum tensile capacity of the connector assembly 28. Advantages exist by uniformly coating the inner surface of the slip assembly 38 with particles 40 or grit, such as the ability to provide a uniformly distributed load along a length of contact and/or interface between the slip assembly 38 and tubing 22. In an example, the slip assembly 38 is loaded to a proscribed amount to avoid damaging the tubing 22 or the particles 40 or grit.

Figure 3A:
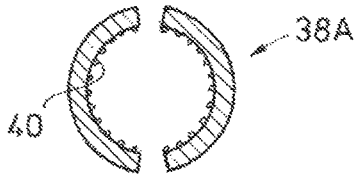
FIGS. 3A and 3B are axial sectional views of alternate embodiments of a slip assembly for use with the connector assembly of FIG. 2.
Figure 3B:
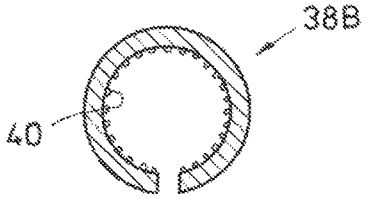

FIGS. 3A and 3B show alternate embodiments of the slip assembly 38A, 38B in an axial sectional view. More specifically, as shown in FIG. 3A the slip assembly 38A is made up of a pair of split C rings with gaps disposed at roughly 180° apart from one another. Further, the particles 40 are shown provided along the inner diameter of each of these split portions. In FIG. 3B the slip assembly 38B has a C ring type configuration with the particles 40 on its inner diameter. The C ring configuration has a single gap along the circumference of the slip assembly 38 which may allow for the opposing ends of the slip assembly 38B to move towards one another when the slip assembly 38B is put into the retaining configuration as shown in FIG. 2.

Figure 4A:
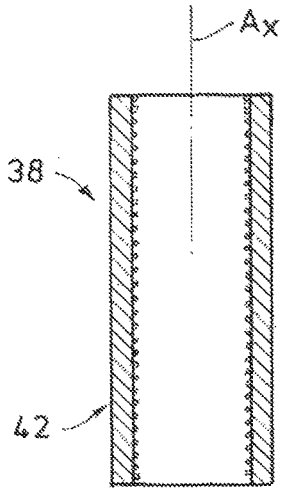
FIGS. 4A-4C are side sectional views of alternate embodiments of a slip assembly for use with the connector assembly of FIG. 2.
Figure 4B:
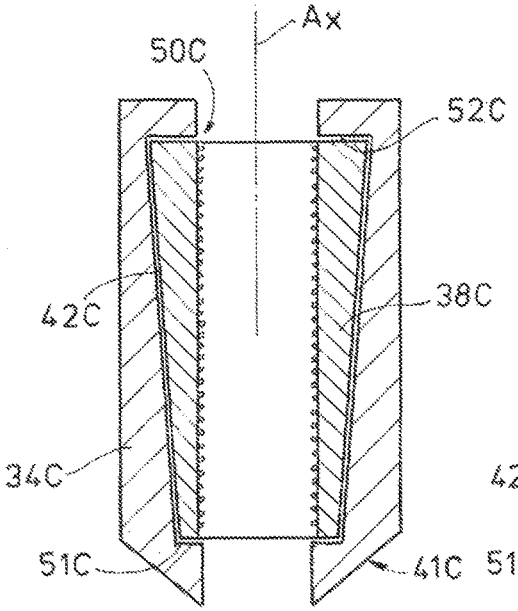
Figure 4C:
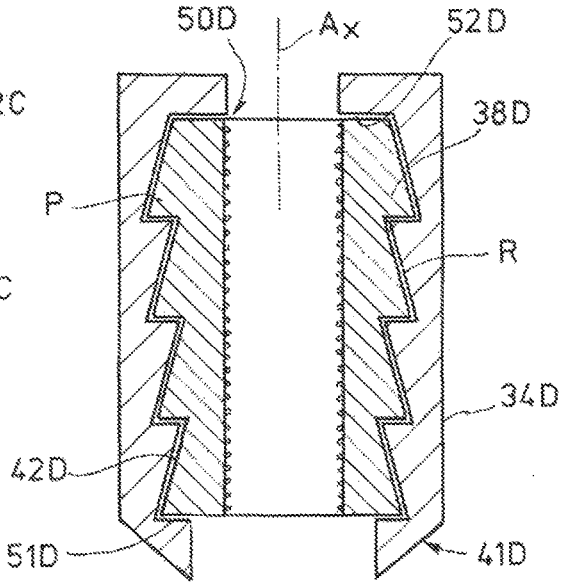

FIGS. 4A through 4C show alternate examples of slip assembly 38, 38C, 38D taken along a side sectional view. In FIG. 4A, the slip assembly 38 has an outer surface 42 that is generally parallel with axis $A_X$ of the slip assembly 38. FIG. 4B shows an example embodiment where the slip assembly 38C has an outer surface 42B with a diameter that changes with distance along axis $A_X$, so that its radius, with respect to axis $A_X$, follows a path that is oblique to axis $A_X$. As such, slip assembly 38C resembles a wedge like member. A recess 50C is shown formed along an inner surface of retainer 34C, and where recess 50C is angled at a profile complementary to the outer surface 42C. Further in the example of FIG. 4B, retainer shoulders 51C, 52C are formed proximate the ends of retainer 34C and at opposing ends of recess 50C. Shoulders 51C, 52C provide backstops for maintaining slip assembly 38C within recess 50C. Further in the example, outer diameter of retainer 34C is substantially constant along its axial length and end 41C is canted at an angle oblique to axis $A_X$.

Shown in side sectional view in FIG. 4C is another alternate embodiment of the slip assembly 38D where its outer lateral surface 42D has a saw tooth like configuration. Retainer shoulders 51D, 52D are shown formed at the opposing ends of recess SOD that project radially inward past the outer radial periphery of the slip assembly 38D, and thus can retain the slip assembly 38D within retainer 34D. In this example, on outer surface 42D are a series of repeating projections P that project radially outward from axis $A_X$ along a path oblique to axis $A_X$, and then project radially inward along a path that is generally perpendicular to axis $A_X$. The inner surface of retainer 34D is shown having shaped recesses R that are complementary to the projections P on the outer surface of the slip assembly 38D. In the orientation as shown, the recesses R on the inner surface of the retainer 34D define landing surfaces for the respective downward facing portions of the projections P on the outer surface slip assembly 38D. In the illustrated example, the end 41D of retainer 34D proximate retainer shoulder 51D is selectively landed on shoulder 32 of connector housing (FIG. 2). Thus the generally horizontally oriented portions of projections P are supported by recesses R to couple slip assembly 38D to retainer 34D. In an alternative, the vertical orientation of slip assembly 38D and retainer 34D is reversed so that the end of retainer 34D proximate retainer shoulder 52D is selectively landed on shoulder 32 of connector housing (FIG. 2). In this alternate embodiment, relative axial movement of slip assembly 38D towards retainer shoulder 52D, in combination with the respective angled surfaces of the projections P and recesses R, causes the slip assembly 38D and retainer 34D to generate a resultant force in a direction from retainer shoulder 52D to retainer shoulder 51D. Thus in this alternate embodiment, the obliquely angled surfaces of the projections P and recesses R couple together the slip assembly 38D and retainer 34D. In another example (not shown), the ends 51D, 52D do not project radially inward past the slip assembly 38D; and thus the interface alone between the projections P and recesses R as described above couples the slip assembly 38D and retainer 34D.

Further, in addition to the uniform placement of the particles 40, the profiles and configurations of the slip assemblies 38, 38A, 38B, 38C, 38D and retainers 34, 34A, 34B, 34C, 34D can also yield a substantially uniform loading along the axial length of the interface between these slip assemblies and respective retainers. Referring now to FIGS. 4B and 4C, one advantage of a separate retainer 34C, 34D is that the tapered angle of the outer face contacts an correspondingly tapered angle of the retainer 34C, 34D. Further, an axial gap in the retainer 34C, 34D provides increased radial loading of the slip assembly to the tubing.

Figure 5:
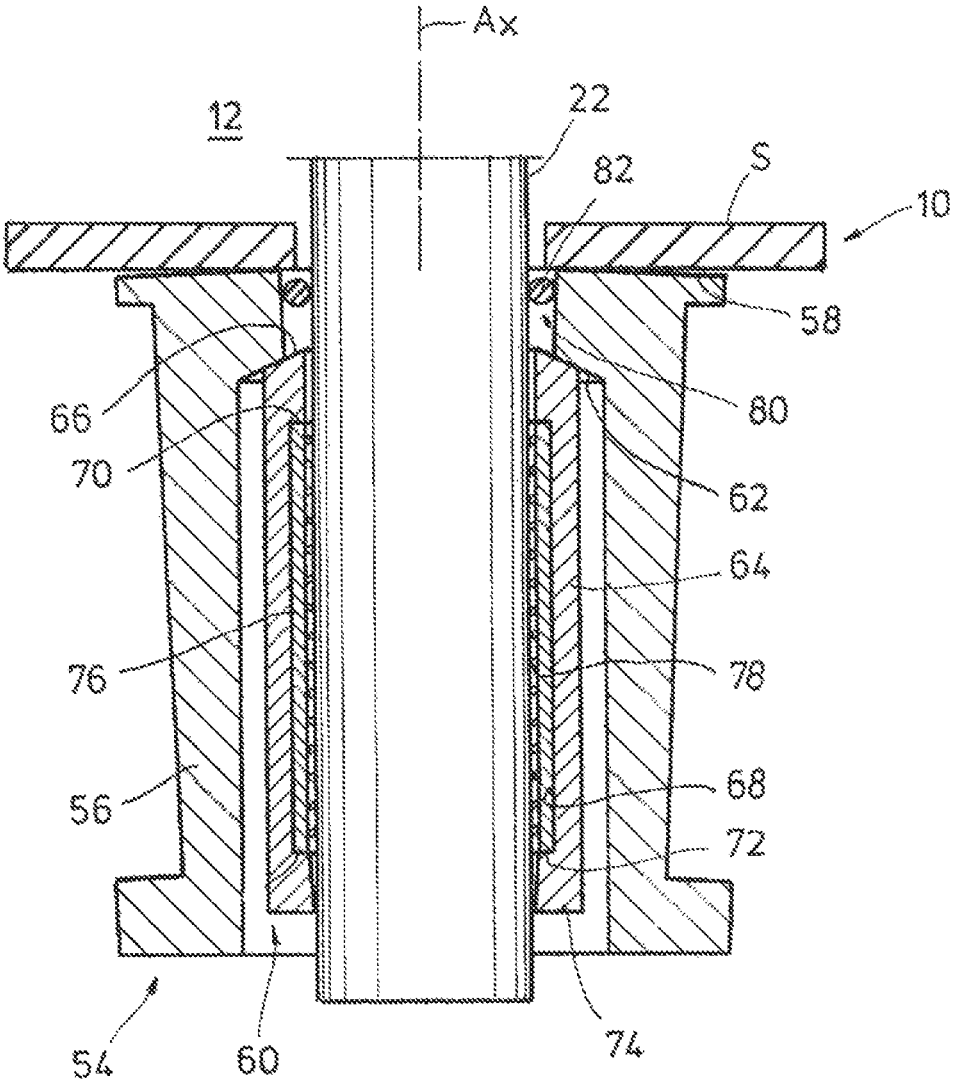
FIG. 5 is a side sectional view of an example of a connector assembly for suspending an ESP system on tubing.

Referring now to FIG. 5 which shows in a side partial sectional view an example of a connector assembly 54 used for coupling a lower portion of the tubing 22 to the ESP assembly 10. Here connector assembly 54 includes an annular connector housing 56 that circumscribes the tubing 22 and has an end 58 in abutting contact with a solid portion S of ESP assembly 10. In one example, the solid portion of ESP assembly 10 is an inner surface of a housing for the pump 16 (FIG. 1). A passage 60 is formed axially through connector assembly 54. Proximate end 58 and on an inner surface of connector assembly 54, the passage 60 transitions radially inward to define a shoulder 62 having a surface that faces away from solid portion S. In the illustrated example shoulder 62 is frusto-conically shaped so that its radially projecting surface angles along a path generally oblique to axis $A_X$ of tubing 22. An annular retainer 64 is further illustrated and that is in close contact with the outer surface of tubing 22 and inserted within the connector assembly 54. Embodiments of retainer 64 include a tubular like member, a split ring, or C-ring type configuration. An end 66 of retainer 64 is profiled similar to the shape of shoulder 62 and is beveled so that when traversing radially along end 66, the surface of end 66 follows a path oblique to axis $A_X$ of tubing 22. Thus when forcing retainer 64 against shoulder 62, the complementary surfaces of shoulder 62 and end 66 urge retainer 64 radially inward and in compressive engagement with tubing 22. Similar to the connector assembly of FIG. 2, the axial tensile forces of holding the tubular 22 can force retainer 64 against shoulder 62.

Retainer 64 includes a recess 68 formed along a portion of its inner surface and which defines a retainer shoulder 70 proximate end 66. Recess 68 forms another retainer shoulder 72 proximate an end 74 of retainer 64 that is distal from end 66. Set within recess 68 is an annular slip assembly 76 that is retained between shoulders 70, 72. Slip assembly 76, which is similar to slip assembly 38 of FIG. 2, is equipped with particles 78 or grit on its inner surface. In an example embodiment, particles 78 or grit is similar to, or the same as, particles 40 or grit of FIG. 2 in all aspects, including but not limited to its construction and composition, and how it is applied to slip assembly 76. Accordingly, by urging retainer 64 radially inward as described above, slip assembly 76 and grit 78 are urged radially inward so that grit 78 engages tubing 22. The combination of the end 58 of the connector assembly 54 abutting a portion of ESP assembly 10, the retainer 64 landed in connector assembly 54, and slip assembly 76 retained in retainer 64, and tubing 22 coupled to slip assembly 76, axially affixes the tubing 22 to ESP assembly 10. Moreover, similar to embodiments of retainers 38A, 38B of FIGS. 3A and 3B discussed above, alternate embodiments of slip assembly 76 include a split ring, C-ring, constant outer and inner diameters, varying inner and or outer diameters, a saw tooth outer diameter, and combinations thereof. Further shown in FIG. 5 in an annular space 80 defined in passage 60 between connector housing 56 and tubing 22 and adjacent solid portion S of ESP assembly 10. A seal 82 is shown in annular space 79 which defines a flow barrier between inside of ESP assembly 10 and wellbore 12. In the example of FIG. 5, seal 82 is an O-ring, but can be any type of device for blocking fluid flow.

Figure 6:
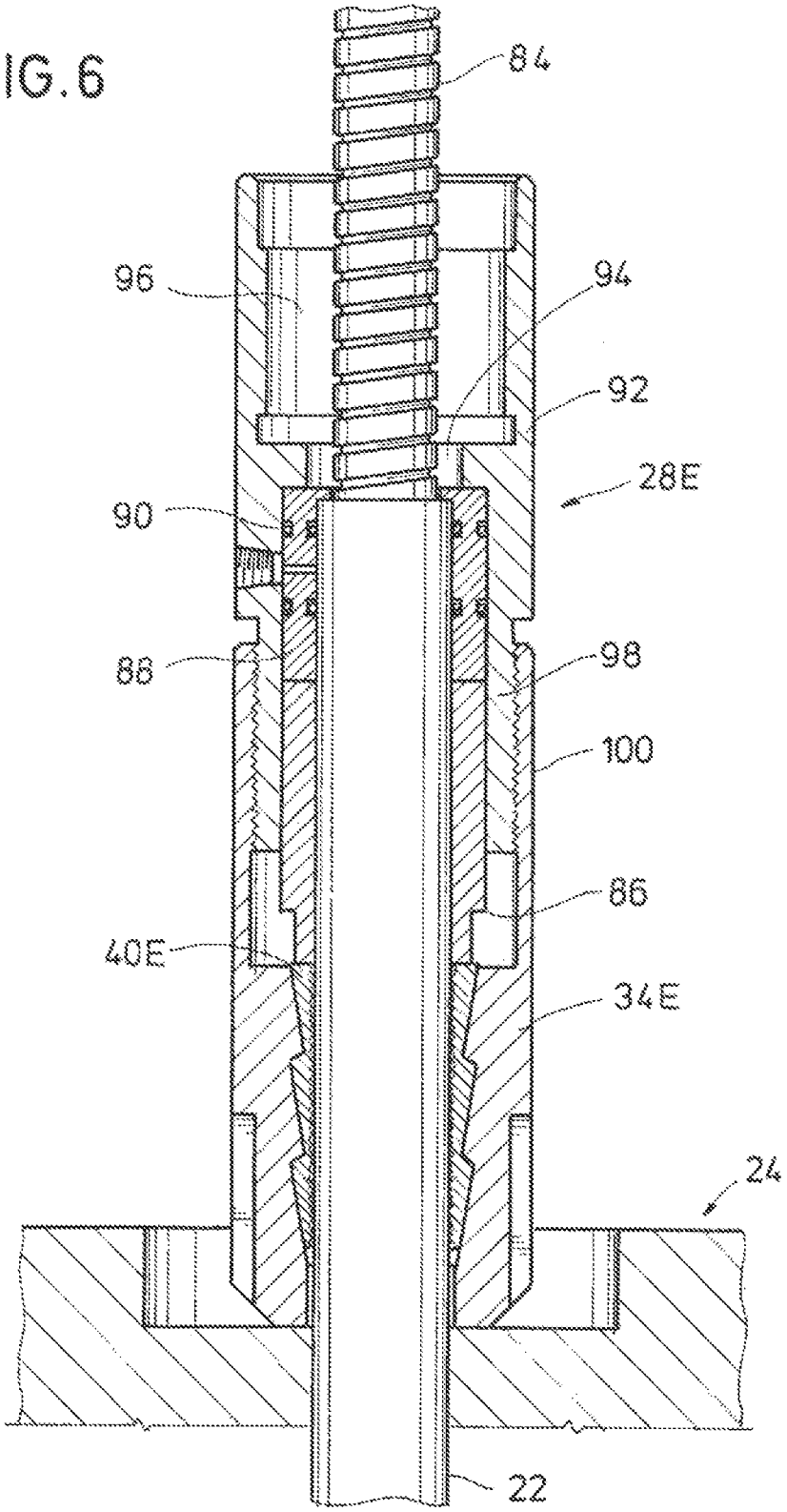
FIG. 6 is a side partial sectional view of an alternate example of the connector assembly of FIG. 2.

An alternate embodiment of the connector assembly 28E is shown in a partial side sectional view in FIG. 6. Here, the embodiments of the retainer 34E and slip assembly 40E illustrated have the saw tooth like configuration similar to that provided in FIG. 4C. Also, a cable 84 is shown disposed within the tubing 22, and which includes an armored sheath. An annular push cylinder 86 circumscribes the tubing 22 above the slip assembly 40E, and in one example exerts an axial force against slip assembly 40E to energize slip assembly 40E unto gripping contact with the tubing 22. An O-ring carrier 88, which is also annular, is shown circumscribing the tubing 22 on an end of push cylinder 86 distal from slip assembly 40E. O-rings 90 are provided along inner and outer surfaces of the O-ring carrier 88 that form sealing interfaces between the tubing 22 and a protective casing 92. Protective casing 92 is an annular member with a bore 94 that transitions radially inward above a upper terminal end of the O-ring carrier 68 and which provides an axial restraint for the O-ring carrier 68 on an end opposite the push cylinder 86. Bore 94 transitions radially outward at an axial distance above O-ring carrier 68 to define a cavity 96 that intersects the upper terminal end of casing 92. Bore 94 transitions radially outward at an end of casing 92 distal from cavity 96 to define a skirt 98 which is shown circumscribing a portion of push cylinder 86. The inner radius at an upper end of retainer 34E, and distal from where retainer lands on wellhead assembly 24, is enlarged and forms a collar 100, which is shown circumscribing skirt 98. Optionally, collar 100 may be threadingly coupled to skirt 98.

One advantage of implementation of one or more of the embodiments described herein is that an ESP may be deployed without the need for a rig, which saves time and substantial cost. Moreover examples exist wherein electricity for powering the motor 14 (FIG. 1) is deployed within tubing 22, or alongside tubing 22. As indicated above, the timing 22 can be formed from a composite material which may include individual strength member strands. An advantage of the present device is that other known methods of supporting a composite tubular involves separating out the strength member strands and affixing them to the particular connector being used for supporting this type of a tubular perimeter.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. This connector can be used on metallic conduits where corrosive fluids may cause premature connector failure due to high stress loads in conventional slip type connectors. These and other similar modifications will readily suggest themselves to those skilled in the art, and are intended to be encompassed within the spirit of the present invention disclosed herein and the scope of the appended claims.

What is claimed is:

1. A system for producing fluid from a wellbore comprising:

a wellhead assembly disposed proximate an opening of the wellbore;

an annular umbilical having a portion in the wellhead assembly and a portion that depends into the wellbore;

a connector assembly supported in the wellhead assembly and comprising, an annular connector housing having a radial shoulder on an inner surface that is profiled oblique to an axis of the umbilical, an annular retainer in the connector housing and having a lower radial surface profiled oblique to the axis of the umbilical, a recess formed in an inner radial surface of the retainer, an annular slip assembly retained in the recess, and particles embedded in an inner surface of the slip assembly, so that when the retainer moves axially towards the radial shoulder, the retainer and the slip assembly are urged radially inward and the particles project radially inward into engaging contact with an outer surface of the umbilical; and a downhole assembly coupled to an end of the umbilical distal from the wellhead assembly.

2. The system of claim 1, wherein engagement between the particles and the umbilical is non-marking.

3. The system of claim 1, wherein upper and lower ends of the retainer extend axially past respective upper and lower ends of the slip assembly.

4. The system of claim 1, wherein the downhole assembly comprises an electrical submersible pumping system and which discharges fluid into the umbilical for pumping the fluid to the wellhead assembly.

5. The system of claim 1, wherein the connector assembly comprises an upper connector assembly, the system further comprising a lower connector assembly that comprises an annular connector housing, an annular slip assembly retained in the connector housing, and particles embedded in an inner surface of the slip assembly and that project radially inward into engaging contact with the outer surface of the umbilical.

6. The system of claim 5, wherein the lower connector assembly couples the downhole assembly to the umbilical, and wherein the annular connector housing of the lower connector assembly is in engaging contact with an inner surface of a housing of the downhole assembly.

7. The system of claim 1, wherein the retainer has an end supported on the shoulder, and wherein the end of the retainer is profiled complementary to the shoulder, so that when the particles grip the umbilical, the retainer is urged radially inward and to increase a gripping force exerted by the retainer against the umbilical.

8. The system of claim 1, wherein the connector assembly lands on a support formed in the wellhead assembly.

9. The system of claim 1, wherein the connector assembly comprises an upper connector assembly, wherein the downhole assembly comprises an electrical submersible pumping system, and which is coupled to the umbilical with a lower connector assembly.

10. The system of claim 1, further comprising a matrix on the inner surface of the slip assembly and in which the particles are disposed.

11. The system of claim 10, wherein a gap between the connector housing and the retainer extends axially along a sidewall of the retainer.

12. The system of claim 1, wherein a diameter of the slip assembly tapers radially inward from an upper end to a lower end, and wherein an inner diameter of the retainer tapers radially inward along a path that corresponds to the diameter of the slip assembly, so that a force applied from the slip assembly to the umbilical is uniform along a length of an interface between the slip assembly and the umbilical.

13. The system of claim 1, wherein a series of frusto-conical shaped projections are formed on an outer surface of the slip assembly and which fit into a series of frusto-conical shaped recesses on the inner surface of the retainer, so that a force applied from the slip assembly to the umbilical is uniform along a length of an interface between the slip assembly and the umbilical.

14. A system for producing fluid from a wellbore comprising:

a wellhead assembly mounted at an opening of the wellbore;

an annular umbilical that depends into the wellbore and that has an end supported in the wellhead assembly;

an upper connector assembly supported in the wellhead assembly and comprising, an annular connector housing, an annular retainer in the connector housing having a lower end profiled to urge the retainer radially inward with axial movement towards the opening, an annular slip assembly disposed in the retainer, a matrix material on an inner surface of the slip assembly, and particles embedded in the matrix material that project radially inward into engaging contact with an outer surface of the umbilical and that are disposed so that the loading between the slip assembly and the umbilical is substantially uniform along an axial length of an interface between the slip assembly and the umbilical;

a downhole assembly coupled to a portion of the umbilical distal from the wellhead assembly; and a lower connector assembly disposed in the downhole assembly comprising, an annular connector housing in compressive engagement with a housing of the downhole assembly, an annular slip assembly retained in the connector housing, a matrix material on an inner surface of the slip assembly, and particles embedded in the matrix material that project radially inward into engaging contact with the outer surface of the umbilical and that are disposed so that the loading between the slip assembly and the umbilical is substantially uniform along an axial length of an interface between the slip assembly and the umbilical.

15. The system of claim 14, wherein the particles comprise a material that is selected from the group consisting of silicon, silicon carbide grit, and combinations thereof, and wherein the particles protrude from the matrix material a height of up to about 0.03 inches.

16. A system for producing fluid from a wellbore comprising:

a wellhead assembly disposed proximate an opening of the wellbore;

a tubular member that is formed of a composite material and that has a portion in the wellhead assembly and a portion that depends into the wellbore;

an upper connector assembly supported in the wellhead assembly and that comprises, an annular connector housing, an annular retainer in the connector housing, an annular gap between the connector housing and the retainer that extends axially from a lower end of the retainer to an upper end of the retainer, an annular slip assembly retained in the connector housing with the retainer, and particles embedded in an inner surface of the slip assembly and that project radially inward into engaging contact with an outer surface of the tubular member;

an electrical submersible pumping assembly comprising a pump and a housing, and that is coupled to the portion of the tubular member that depends into the wellbore; and a lower connector assembly disposed within the electrical submersible pumping assembly and that comprises, an annular connector housing that compressively engages an inner surface of the housing of the electrical submersible pumping assembly, an annular slip assembly retained in the connector housing with a retainer, and particles embedded in an inner surface of the slip assembly and that project radially inward into engaging contact with the outer surface of the tubular member.

17. The system of claim 16, wherein loading between the slip assembly of the upper connector assembly and the tubular member is substantially uniform along an axial length of an interface between the slip assembly of the upper connector assembly and the tubular member.

18. The system of claim 16, wherein an inner surface of the connector housing in the upper connector assembly has a diameter that is profiled radially inward to define a frusto-conical shoulder, wherein the retainer in the upper connector assembly has an end supported on the shoulder, and wherein the end of the retainer in the upper connector assembly is profiled complementary to the shoulder, so that when the particles grip the tubular member, the retainer in the upper connector assembly is urged radially inward and to increase a gripping force exerted by the retainer in the upper connector assembly against the tubular member, and wherein the retainer in the upper connector assembly comprises curved sections.

19. The system of claim 16, wherein the tubular member comprises an umbilical and that supports an umbilical cable, wherein the umbilical cable provides electrical or hydraulic power to the electrical submersible pumping assembly.

* * * * *